US011298799B2

(12) United States Patent
Brand

(10) Patent No.: US 11,298,799 B2
(45) Date of Patent: Apr. 12, 2022

(54) DUAL SIDED SHOT PEENING OF BLISK AIRFOILS

(71) Applicant: General Electric Company, Schenectady, NY (US)

(72) Inventor: Terrance Alan Brand, Derry, NH (US)

(73) Assignee: General Electric Company, Schenectady, NY (US)

( * ) Notice: Subject to any disclaimer, the term of this patent is extended or adjusted under 35 U.S.C. 154(b) by 232 days.

(21) Appl. No.: 15/969,914

(22) Filed: May 3, 2018

(65) Prior Publication Data

US 2019/0337120 A1 Nov. 7, 2019

(51) Int. Cl.
*B21D 31/06* (2006.01)
*B24C 1/10* (2006.01)

(52) U.S. Cl.
CPC ..... *B24C 1/10* (2013.01); *B21D 31/06* (2013.01)

(58) Field of Classification Search
CPC ..... B21D 31/06; B24C 1/10; B24B 39/006; C21D 7/06
See application file for complete search history.

(56) References Cited

U.S. PATENT DOCUMENTS 3,482,423 A 12/1969 Murray et al.
4,329,862 A 5/1982 Harburn
5,176,018 A 1/1993 Thompson
5,531,570 A 7/1996 Mannava et al.
5,596,912 A 1/1997 Laurence et al.
5,813,265 A 9/1998 Shaw
6,296,448 B1 10/2001 Suh et al.
6,541,733 B1 4/2003 Mannava et al.
6,570,125 B2 5/2003 Suh et al.
7,125,322 B1 * 10/2006 Champaigne ..... B24C 1/045 451/89
7,217,102 B2 5/2007 Rockstroh et al.
8,256,117 B2 9/2012 Hennig
8,739,589 B2 6/2014 Hennig et al.
9,027,375 B2 5/2015 Hennig et al.
(Continued)

FOREIGN PATENT DOCUMENTS

CN 1444663 A 9/2003
CN 1525901 A 9/2004
(Continued)

OTHER PUBLICATIONS

EP 1 741 796 B1, European Patent Specification, "Countering laser shock peening induced airfoil twist using shot peening", Rockstroh et al., dated Jun. 11, 2013.
(Continued)

*Primary Examiner* — Debra M Sullivan
(74) *Attorney, Agent, or Firm* — Fitch, Even, Tabin & Flannery LLP

(57) ABSTRACT

Dual sided shot peening system includes pressurized air supply in communication with independently controllable first and second air pressure regulators in communication with first and second shot supplies and independently controlled first and second shot flow control valves disposed between first and second nozzles and the shot supplies. Computer may be in control of regulators and valves. Nozzle supports may fixedly or movably support nozzles during shot peening. The system may be used for simultaneously shot peening first and second sides of a portion of a workpiece such as airfoils of a BLISK. First and second streams from first and second nozzles may have different properties and may be varied during shot peening.

20 Claims, 12 Drawing Sheets

(56) References Cited

U.S. PATENT DOCUMENTS

| | | | | |
|---|---|---|---|---|
| 2010/0043512 | A1* | 2/2010 | Bayer | B24C 1/10 72/53 |
| 2010/0180738 | A1 | 7/2010 | Tavger | |
| 2010/0221118 | A1* | 9/2010 | Prevey, III | B23P 15/006 416/241 R |
| 2016/0059382 | A1 | 3/2016 | Kondo et al. | |

FOREIGN PATENT DOCUMENTS

| | | | |
|---|---|---|---|
| CN | 203018909 | U | 6/2013 |
| CN | 105382708 | A | 3/2016 |
| CN | 107791157 | A | 3/2018 |
| DE | 102016100663 | A1 | 7/2017 |
| EP | 0245602 | A2 | 11/1987 |
| EP | 1288317 | A1 | 3/2003 |

OTHER PUBLICATIONS

"Shot peening", Dual Sided Peening of Aircraft Structural Components, System features & benefits, 2016-2018 Progressive Surface, 7 pages.

European Search Report Corresponding to Application No. 19172372 dated Oct. 1, 2019.

Chinese Search Report Corresponding to Application No. 201910369089 dated Nov. 6, 2020.

Bin, Hongzan; "Digital Control of Machining Processes"; Huazhong University of Science and Technology Press; 2004; 2nd Edition; Chapters 7-4 and 7-5; 22 pages (with English translation).

* cited by examiner

DUAL SIDED SHOT PEENING OF BLISK AIRFOILS

BACKGROUND OF THE INVENTION

Technical Field

The present invention relates generally to shot peening airfoils and, more particularly, dual sided shot peening of airfoils or blades on disks, sometimes referred to as BLISKS.

Background Information

Shot peening of workpieces is a well known method of impacting surfaces with a spherical shot peening medium delivered at high speed by compressed air. This imparts residual compressive stresses which reduce the chance of crack formation and improve fatigue strength. Benefits include weight reduction, work hardening and increased service life. As is generally known, shot peening may be used for engine components such as blades of BLISKS. Integrally formed bladed rotor sections are also referred to as integrally bladed rotors (IBR) or integrally bladed disks (BLISK) having one or more spaced apart rows of blades or airfoils integrally mounted or formed on a drum rotor or disk respectively. Thin airfoil designs have posed challenges to shot peening, particularly, with regards to maintaining airfoil geometry during shot peening and preventing or minimizing airfoil deflection during shot peening. Dual sided shot peening of blades or airfoils is known using regulation of the media or shot flow at the same air pressure resulting in the operator or peenist being limited in how they can address airfoil motion, particularly, since media flow also impacts shot peen coverage. It is, thus, desirable to provide NC programs that can directly manage airfoil motion during shot peening.

SUMMARY OF THE INVENTION

A dual sided shot peening system includes a pressurized air supply in pressurized air supply communication with independently controllable first and second shot peening air pressure regulators in pressurized air supply communication with first and second shot supplies respectively and independently controlled first and second shot flow control valves operably disposed between the first and second shot supplies and shot peening first and second nozzles respectively.

A computer may be controllably connected to the first and second shot peening air pressure regulators and the first and second shot flow control valves. First and second nozzle supports may support the first and second nozzles respectively and be operable for fixedly or movably supporting the nozzles during shot peening. The first and second nozzle supports may be separately and independently movable and operable to linearly move the first and second nozzles towards and away from each other and/or rotate or pivot the first and second nozzles, and/or translate the first and second nozzles along first and second longitudinal axes in first and second lengthwise directions, corresponding to first and second lengths of the first and second nozzles respectively.

The system may include a manipulator operable for supporting and moving a workpiece and for positioning opposite sides of the workpiece between the first and second nozzles during shot peening by the first and second nozzles. The system may include first and second shot flow lines from the first and second shot flow control valves to the first and second nozzles and first and second booster lines from the first and second shot peening air pressure regulators to the first and second shot flow lines respectively.

The workpiece may be a BLISK with airfoils and supported by the manipulator operable for positioning opposite pressure and suction sides of the airfoils between the first and second nozzles during shot peening by the first and second nozzles. The computer may be operable to set different first and second intensities of first and second streams from the first and second nozzles for simultaneously shot peening the pressure and suction sides respectively of the airfoils.

The system computer may be operable to set and vary different properties of first and second streams from the first and second nozzles for simultaneously shot peening the pressure and suction sides respectively of the airfoils. The properties may be selected from the group consisting of shot media flow rate, intensity, impingement angle of media or shot stream exiting the nozzle with respect to a normal vector from an airfoil surface, first and second distances of a nozzle exit relative to the airfoil surface, and position of the nozzle relative to leading and/or trailing edges of the airfoil, position of the nozzle relative to adjacent airfoils, and peen time.

A method for simultaneously shot peening sides of a portion of a workpiece includes shot peening with a dual sided shot peening system including a pressurized air supply in pressurized air supply communication with independently controllable first and second shot peening air pressure regulators, the first and second shot peening air pressure regulators in pressurized air supply communication with first and second shot supplies respectively, and independently controlled first and second shot flow control valves operably disposed between the first and second shot supplies and shot peening first and second nozzles respectively; supplying pressurized air from the pressurized air supply to the first and second shot peening air pressure regulators; flowing pressurized air from the first and second shot peening air pressure regulators into first and second shot supplies containing first and second shot media respectively; metering the first and second shot media from the first and second shot supplies through individually or independently controlled first and second shot flow control valves into first and second streams of the first and second shot media respectively and independently regulating the metering of the first and second shot media with the first and second shot flow control valves respectively; flowing the first and second streams of the first and second shot media from the first and second shot flow control valves to the first and second nozzles respectively; and shooting the first and second streams of the first and second shot media on the first and second sides respectively of the portion of the workpiece.

The method may further include independently controlling the first and second shot flow control valves to flow different amounts of the first and second streams of the first and second shot media and/or independently controlling the first and second shot peening air pressure regulators for flowing pressurized air to the first and second shot supplies at different pressures respectively. The method may further include flowing the first and second streams of the first and second shot media from the first and second shot flow control valves through first and second shot flow lines to the first and second nozzles respectively and flowing pressurized air from the first and second shot peening air pressure regulators through first and second booster lines to the first and second shot flow lines respectively.

The computer may set and vary different properties of first and second streams from the first and second nozzles for simultaneously shot peening the sides respectively.

A method for simultaneously shot peening airfoils of a BLISK includes simultaneously shot peening opposite pressure and suction sides of the airfoils with a dual sided shot peening system including a pressurized air supply in pressurized air supply communication with independently controllable first and second shot peening air pressure regulators, the first and second shot peening air pressure regulators in pressurized air supply communication with first and second shot supplies respectively, and independently controlled first and second shot flow control valves operably disposed between the first and second shot supplies and shot peening first and second nozzles respectively; supporting and moving the BLISK with a manipulator and using the manipulator for positioning the airfoils between the first and second nozzles during shot peening by the first and second nozzles; supplying pressurized air from the pressurized air supply to the first and second shot peening air pressure regulators; flowing pressurized air from the first and second shot peening air pressure regulators into first and second shot supplies containing first and second shot media respectively; metering the first and second shot media from the first and second shot supplies through individually or independently controlled first and second shot flow control valves into first and second streams of the first and second shot media respectively and independently regulating the metering of the first and second shot media with the first and second shot flow control valves respectively; flowing the first and second streams of the first and second shot media from the first and second shot flow control valves to the first and second nozzles respectively; and shooting the first and second streams of the first and second shot media on the pressure and suction sides respectively of the airfoils.

The method may further include supporting and moving the first and second nozzles during the peening with first and second nozzle supports respectively of the system, moving the first and second nozzles linearly towards and away from each other and/or rotating or pivoting the first and second nozzles, and/or translating the first and second nozzles along first and second longitudinal axes in first and second lengthwise directions, corresponding to first and second lengths of the first and second nozzles respectively.

The method may include moving the manipulator to move first and second streams from the first and second nozzles in a serpentine pattern including one or more U-shaped portions.

BRIEF DESCRIPTION OF THE DRAWINGS

The invention, in accordance with preferred and exemplary embodiments, is more particularly described in the following detailed description taken in conjunction with the accompanying drawings in which.

DESCRIPTION

Figure 1:
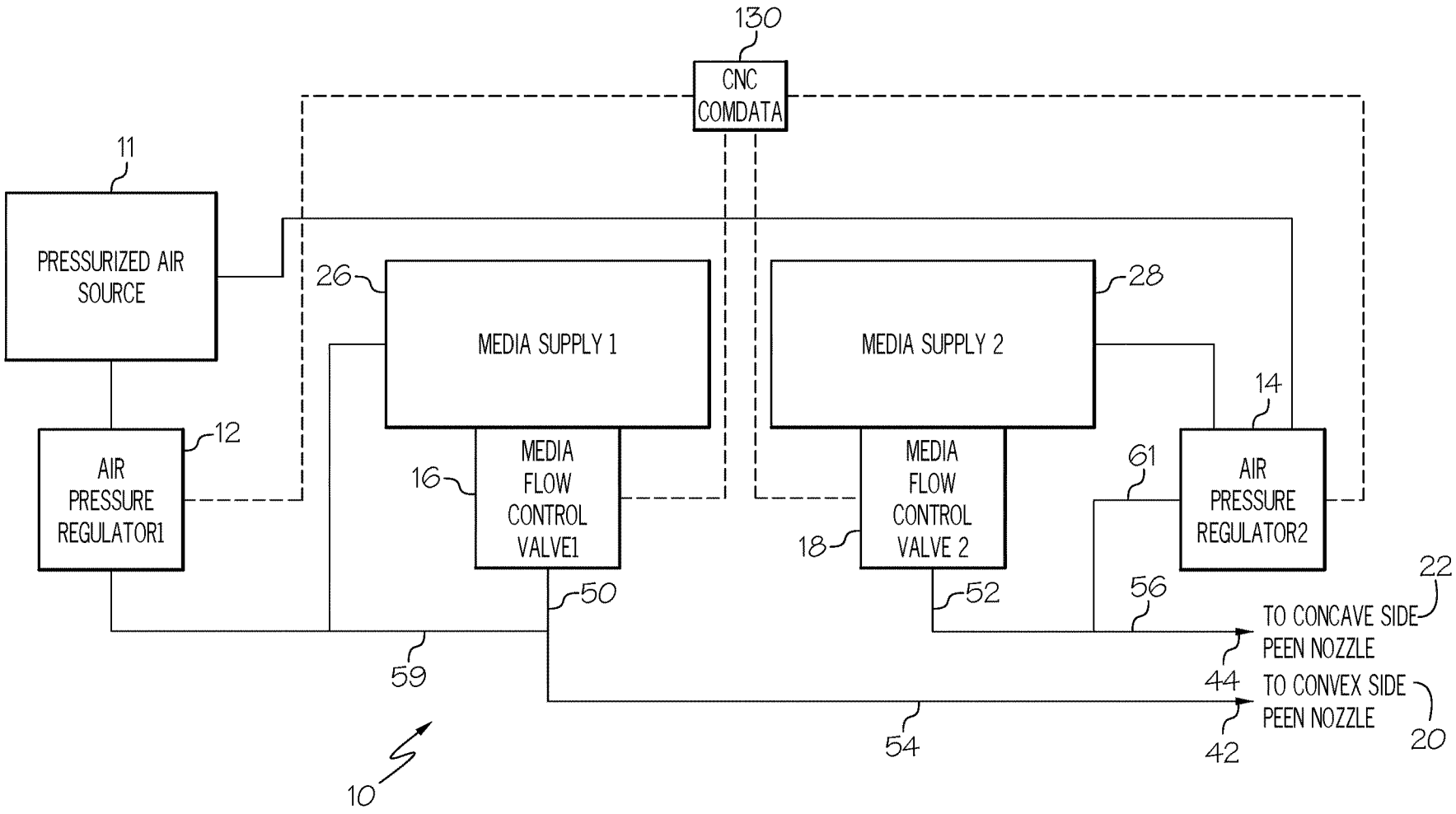
FIG. 1 is a schematic view illustration of a dual sided shot peening system.

Schematically illustrated in FIG. 1 is a dual sided shot peening system 10 for dual sided shot peening. A pressurized air supply 11 supplies pressurized air to individually or independently controlled first and second shot peening air pressure regulators 12, 14. Pressurized air from the independently controllable first and second shot peening air pressure regulators 12, 14 help meter first and second shot media 50, 52 from first and second shot supplies 26, 28 through individually or independently controlled first and second shot flow control valves 16, 18 into first and second streams 42, 44 of the first and second shot media 50, 52 respectively. The individually or independently controlled first and second shot flow control valves 16, 18 of the system 10 individually or independently control the first and second streams 42, 44 of the first and second shot media 50, 52 delivered to shot peening first and second nozzles 20, 22 respectively.

The first and second streams 42, 44 of the first and second shot media 50, 52 are flowed from the first and second shot flow control valves 16, 18 through first and second shot flow lines 54, 56 from the first and second shot flow control valves 16, 18 to the first and second nozzles 20, 22 respectively. The intensity of the streams 42, 44 of the first and second shot media 50, 52 may be increased by further supplying pressurized air from the first and second shot peening air pressure regulators 12, 14, through first and second booster lines 59, 61, to the first and second shot flow lines 54, 56, respectively.

The first and second nozzles 20, 22 supported by first and second nozzle supports 60, 62 respectively are supplied with first and second streams 42, 44 of shot peening medium transported by compressed air by the first and second shot flow lines 54, 56. The first and second shot peening air pressure regulators 12, 14 are separate and independently controlled and the first and second shot flow control valves 16, 18 are separate and independently controlled by a CNC computer 130 or other computer and together they may be used to maintain independent and separate first and second intensities of the first and second streams 42, 44 through the first and second nozzles 20, 22 respectively during peening.

Figure 2:
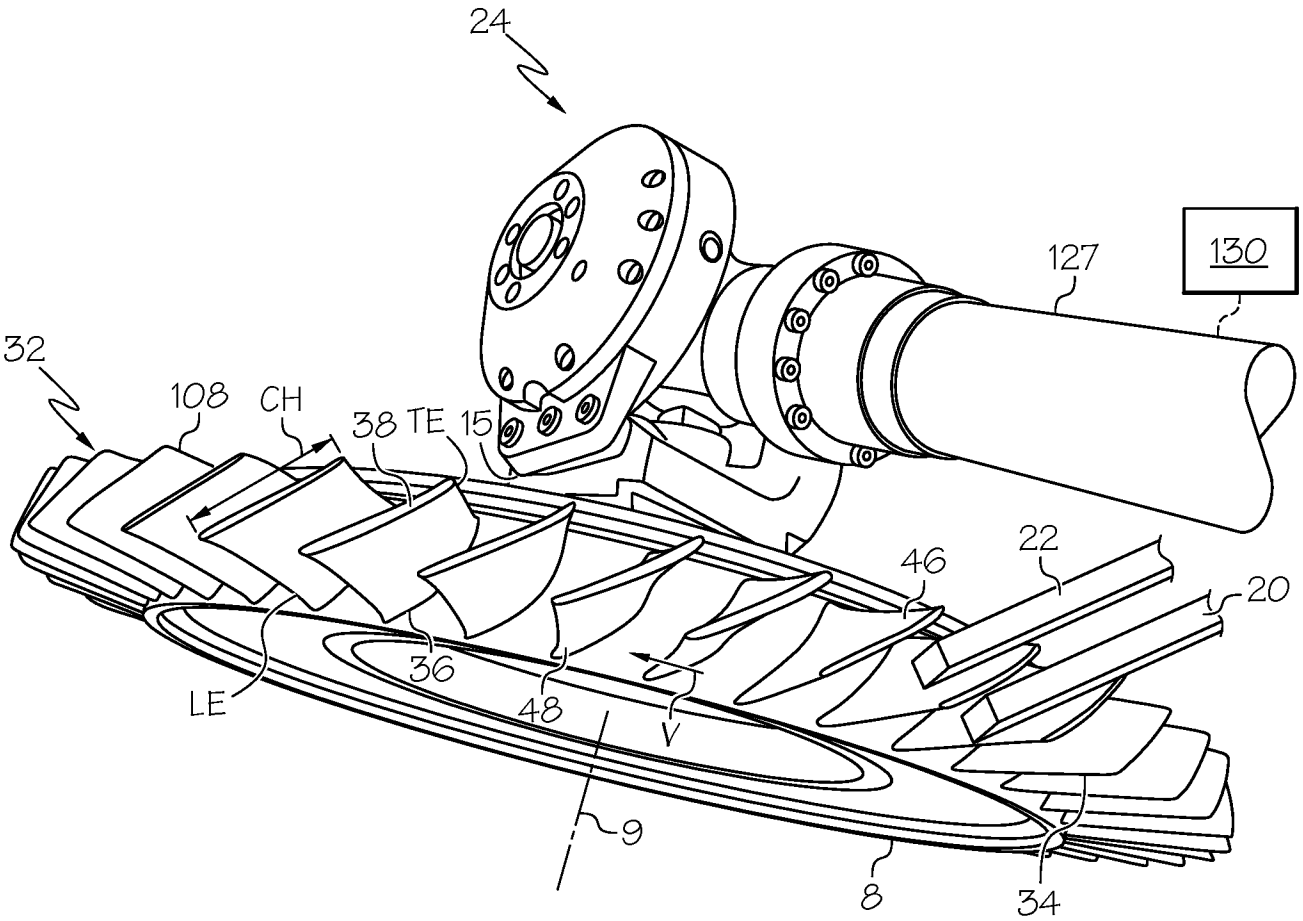
FIG. 2 is a diagrammatic perspective view illustration of an exemplary dual sided shot peening apparatus for peening blades or airfoils of an aircraft gas turbine engine BLISK using the system illustrated in FIG. 1.

Schematically illustrated in FIG. 2 is a dual sided shot peening apparatus 24 that uses the individual or independently controlled first and second shot peening air pressure regulators 12, 14 and the first and second shot flow control valves 16, 18 to operate and supply shot to convex and concave nozzles or the first and second nozzles 20, 22 during peening of an airfoil 34 or blade. Illustrated in FIG. 2 is an integrally bladed disk (BLISK) 8 having an axis of rotation 9 which coincides with a centerline of an aircraft gas turbine engine. The BLISK 8 includes a circumferential row 32 of compressor blades 108 or airfoils 34. For the purposes of this patent, the BLISK 8 is representative of integrally bladed rotor elements and the blades 108 are representative of blades which extend radially outward from the BLISK 8. The airfoils 34 are representative or illustrative of a two sided part of a workpiece, such as BLISK 8, suitable for shot peening.

The BLISK 8 is illustrated in FIG. 2 as being mounted in a workpiece fixture 15 which is attached to a six-axis computer numerically controlled (CNC) manipulator 127. The manipulator 127 is part of the dual sided shot peening apparatus 24. The method and system disclosed herein may be used to simultaneously shot peen pressure and suction sides 46, 48 of blades 108 including fan and turbine blades as well as compressor blades. The manipulator 127 is controlled by a CNC computer 130 or other computer. The shot peening process is also controlled by a computer which may be the CNC computer 130. The first and second shot peening air pressure regulators 12, 14 and first and second shot flow control valves 16, 18 may be independently controlled by the computer such as the CNC computer 130 during the shot peening process.

Figure 3:
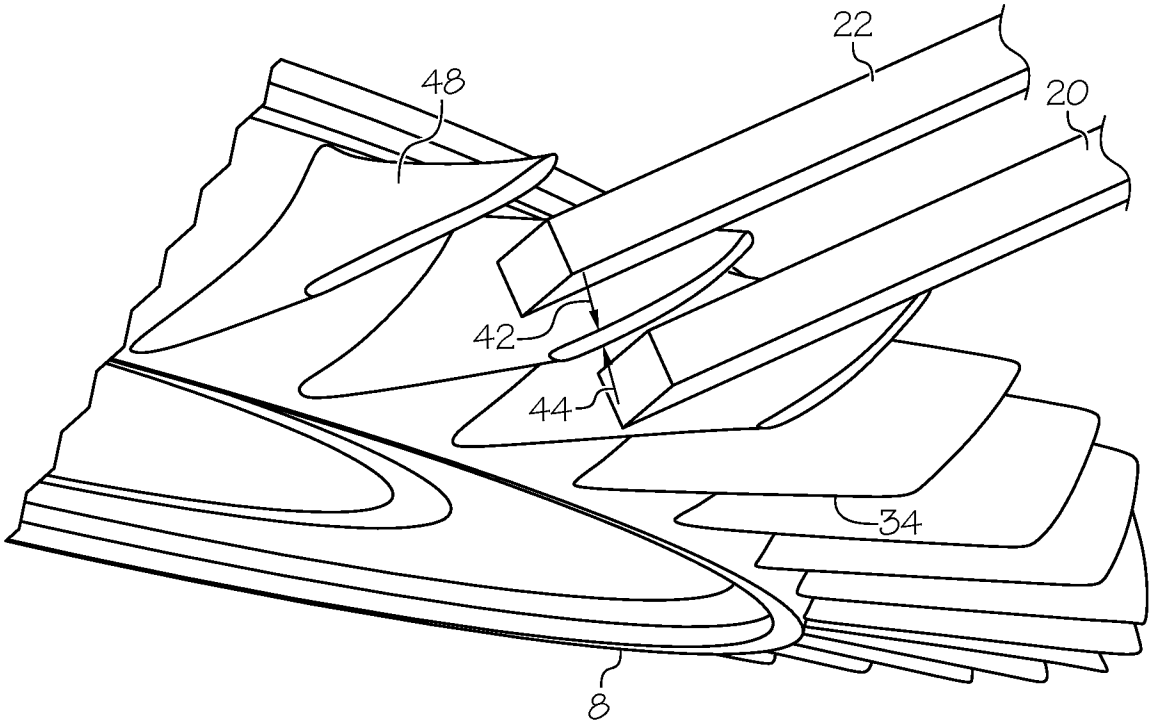
FIG. 3 is an enlarged view of shot peening nozzles of the apparatus illustrated in FIG. 2.

Referring to FIGS. 2 and 3, each compressor blade 108 has an airfoil 34 extending radially outwardly from an airfoil base 36 to an airfoil tip 38 and in the chordwise direction between a leading edge LE and a trailing edge TE of the airfoil. A chord CH of the airfoil 34 is the line between the leading edge LE and trailing edge TE at each cross-section of the blade. Pressure and suction sides 46, 48, respectively, of the airfoil 34 extend between the leading and trailing edges LE, TE of the airfoil. The pressure side 46 faces in the general direction of rotation as indicated by arrow V and the suction side 48 is on the other side of the airfoil.

Figure 4:
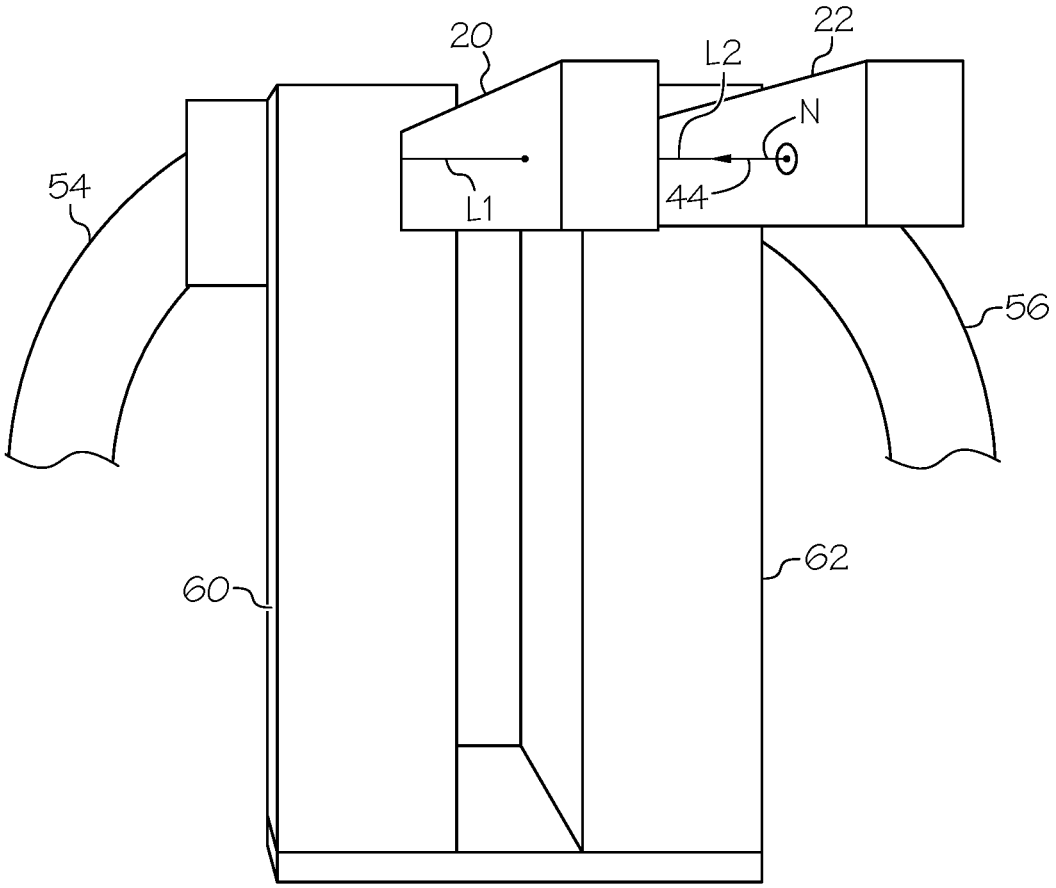
FIG. 4 is a diagrammatic perspective view illustration of an exemplary support fixture for the shot peening nozzles of the apparatus illustrated in FIGS. 2 and 3.

The method of dual sided shot peening system 10 and peening apparatus 24 illustrated in FIGS. 1-5 provides movement of the BLISK 8 and airfoils 34 by the manipulator 127 while the concave and convex nozzles or the first and second nozzles 20, 22 remain stationary supported by the first and second nozzle supports 60, 62 which also remain stationary during the shot peening as illustrated in FIG. 4. The manipulator 127 positions the parts of the workpiece or more specifically the airfoils between the concave and convex nozzles or the first and second nozzles 20, 22 during the shot peening process.

Figure 5:
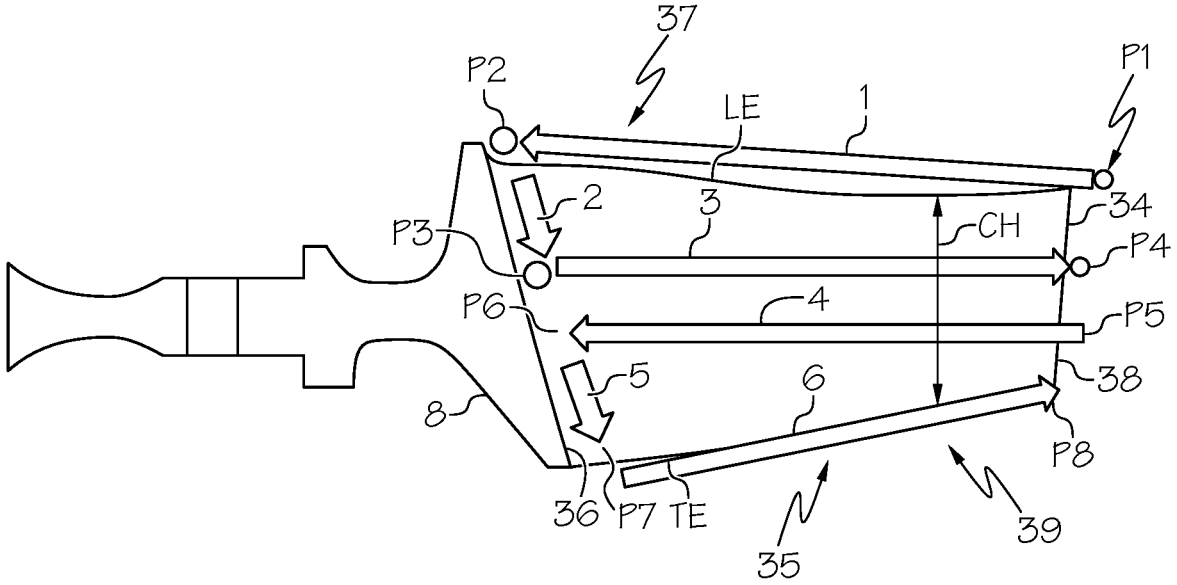
FIG. 5 is diagrammatic view illustration of an exemplary method for shot peening a blade or airfoil in the BLISK using the apparatus and system illustrated in FIGS. 1 and 2.

FIG. 5 illustrates an exemplary dual sided shot peening serpentine pattern 35 or path. The serpentine pattern 35 includes a first U-shaped first portion 37 having a first pass 1 going radially inwardly from a first position P1 located at about the airfoil tip 38 to a second position P2 at the airfoil base 36. The path continues with a second pass 2 in a chordwise direction towards the trailing edge TE from the second position P2 to a third position P3 and then with a third pass 3 in a radially outwardly direction from the third position P3 to a fourth position P4 at about the airfoil tip 38. The serpentine pattern 35 or path includes a U-shaped second portion 39 spaced chordwise apart from the first portion 37 and having a fourth pass 4 going radially inwardly from a fifth position P5 located at about the airfoil tip 38 to a sixth position P6 at the airfoil base 36. The path continues with a fifth pass 5 in a chordwise direction towards the trailing edge TE from the sixth position P6 to a seventh position P7 and then with a sixth pass 6 in a radially outwardly direction from the seventh position P7 to an eighth position P8 at about the airfoil tip 38. The use of two passes are only for illustrative purposes and the serpentine pattern 35 may include more U-shaped portions. The serpentine pattern may be turned sideways or rotated 90 degrees having a first pass going in a chordwise direction between the leading and trailing edges.

Figure 7:
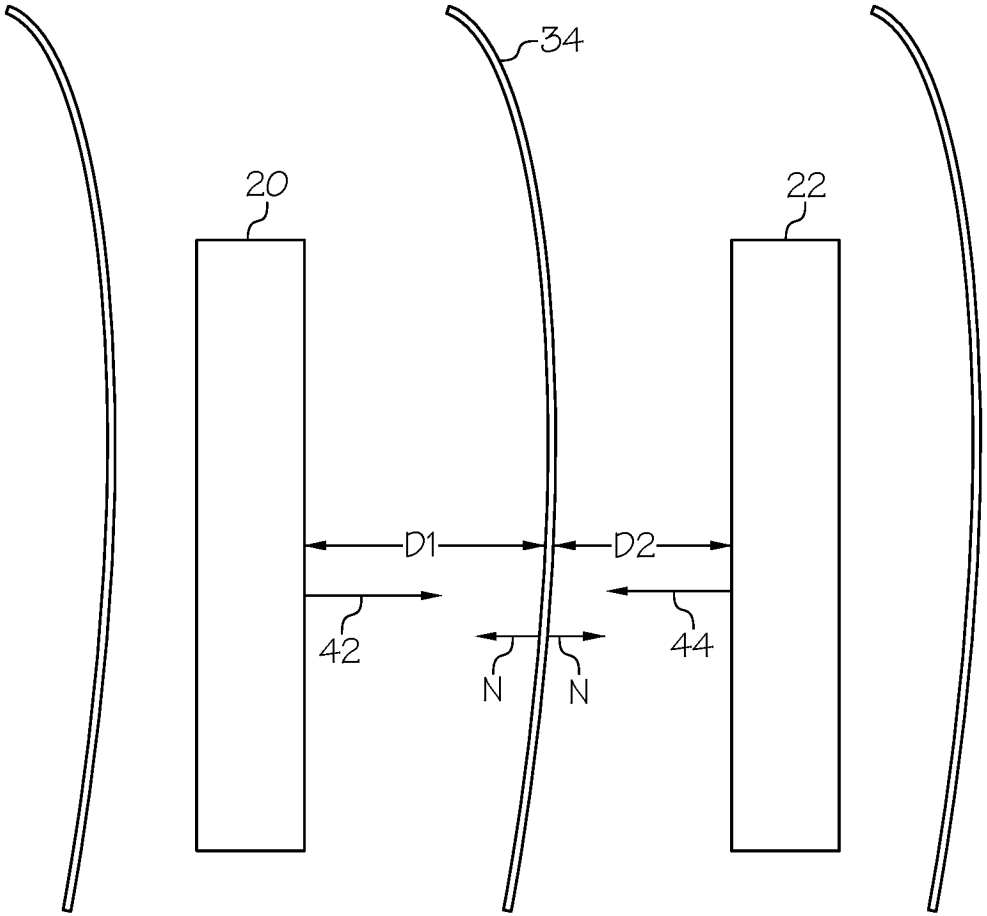
FIG. 7 is a diagrammatic view illustration of exemplary opposite streams of shot from the shot peening nozzles of the apparatus peening opposite sides of the airfoil illustrated in FIGS. 2 and 3.
Figure 10:
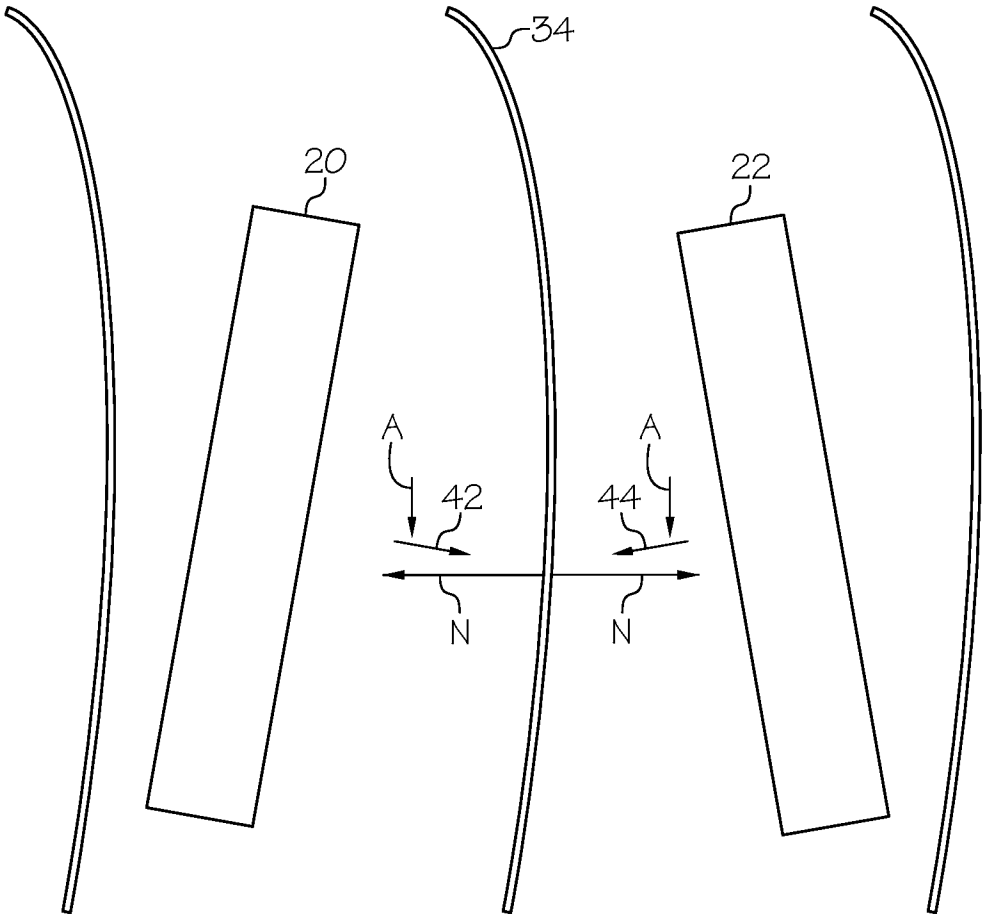
FIG. 10 is a diagrammatic view illustration of second exemplary opposite streams of shot from differently spaced apart and angled opposite peening nozzles peening opposite sides of the airfoil illustrated in FIGS. 2 and 3.

Independent air pressure control provided by the dual sided shot peening system 10 and peening apparatus 24 allows a control computer or CNC computer 130 to directly manage airfoil motion during peening. This makes it possible to take pre-peen airfoil geometric information and run an adaptive program that will maintain required shot peen intensity, while selectively regulating air pressure and media flow during the NC-controlled airfoil and optionally peening nozzles movements and push the airfoil (within limits) to the desired geometric position. Airfoils that have already been peened can be annealed and re-peened to achieve the same effect. The first and second nozzle supports 60, 62 illustrated in FIG. 4 are fixed and the first and second nozzles 20, 22 have fixed and equal first and second lengths L1, L2 respectively. First and second distances D1, D2 from the pressure and suction sides 46, 48 (also referred to as the concave and convex sides) of the airfoil 34 to the first and second nozzles 20, 22 and the length of the first and second streams 42, 44 of shot are fixed and may be equal or unequal during the shot peening as illustrated in FIG. 7. The first and second streams 42, 44 of shot are held normal or along a normal N to the pressure and suction sides 46, 48 of the airfoil 34 as illustrated in FIG. 7 or may be tilted or rotated or canted with respect to the sides and at an acute angle A to the normal N as illustrated in FIG. 10.

Figure 6:
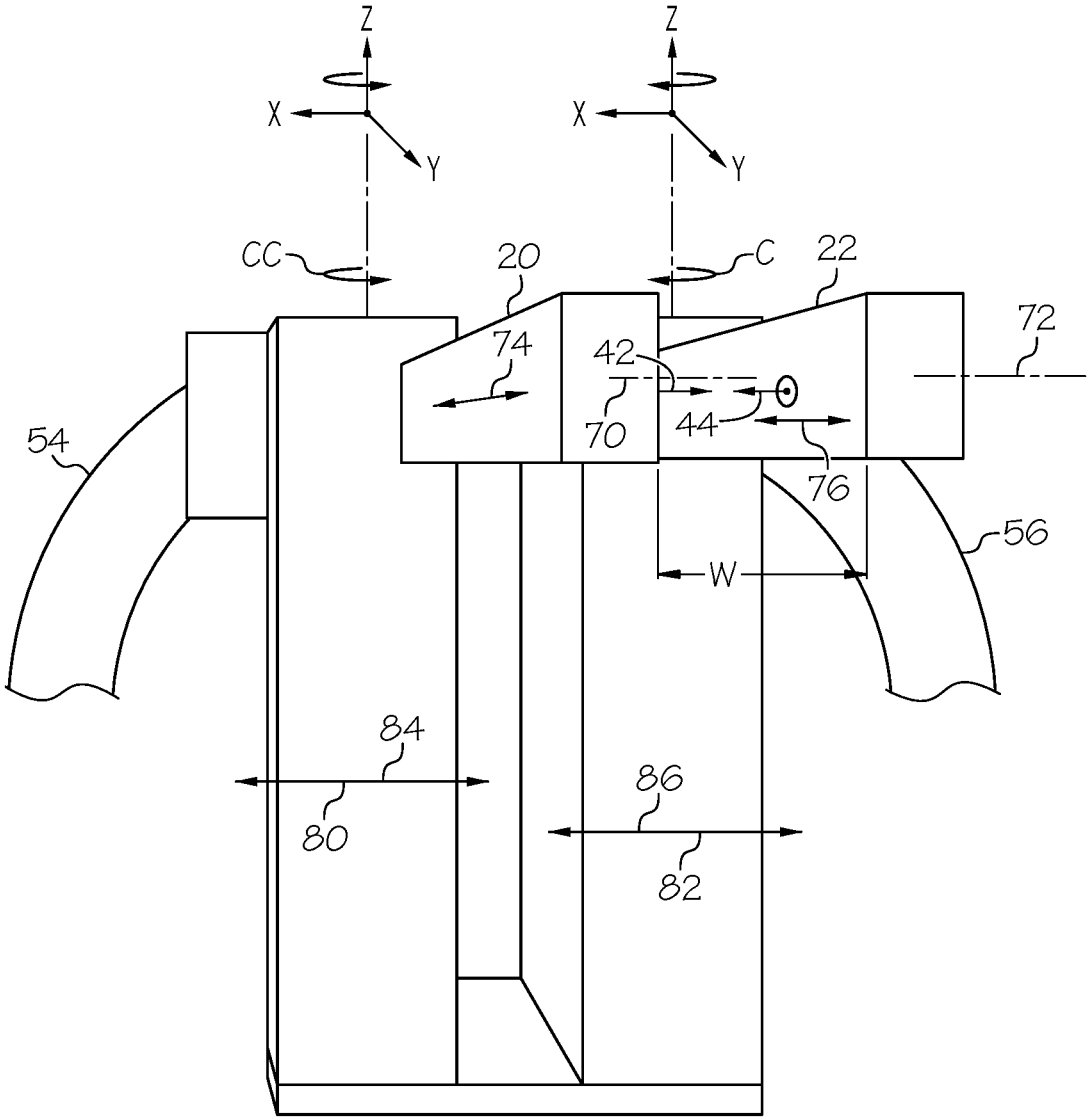
FIG. 6 is a diagrammatic perspective view illustration of an exemplary adjustable support for varying longitudinal and transverse positions of and rotating the dual sided shot peening nozzles of the apparatus illustrated in FIGS. 2 and 3.
Figure 8:
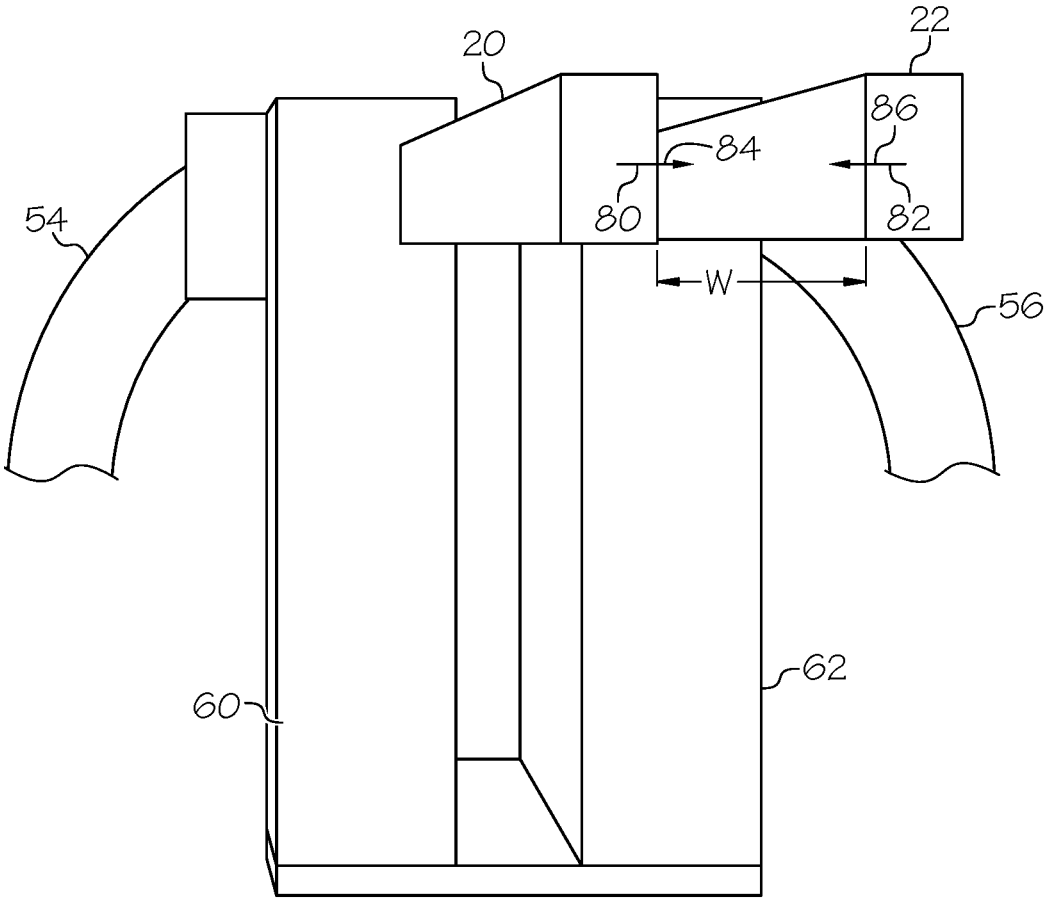
FIG. 8 is a diagrammatic perspective view illustration of an exemplary support for transversely fixed or adjustable dual sided shot peening nozzles of the apparatus illustrated in FIGS. 2 and 3.
Figure 11:
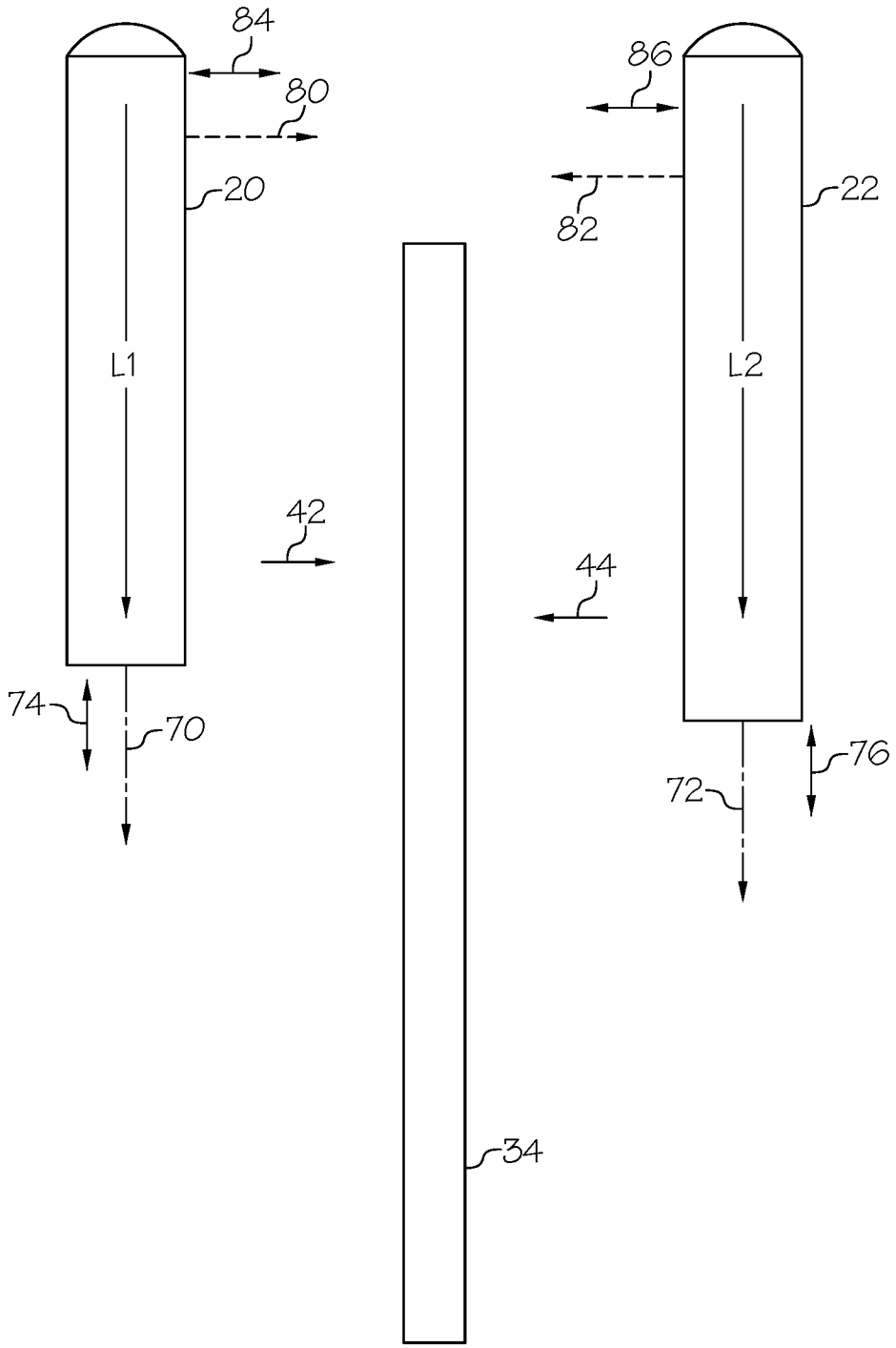
FIG. 11 is a diagrammatic view illustration of an exemplary opposite and radially offset, with respect to a centerline of the BLISK, streams of shot from opposite peening nozzles of the apparatus peening opposite sides of the airfoil illustrated in FIGS. 2 and 3.
Figure 12:
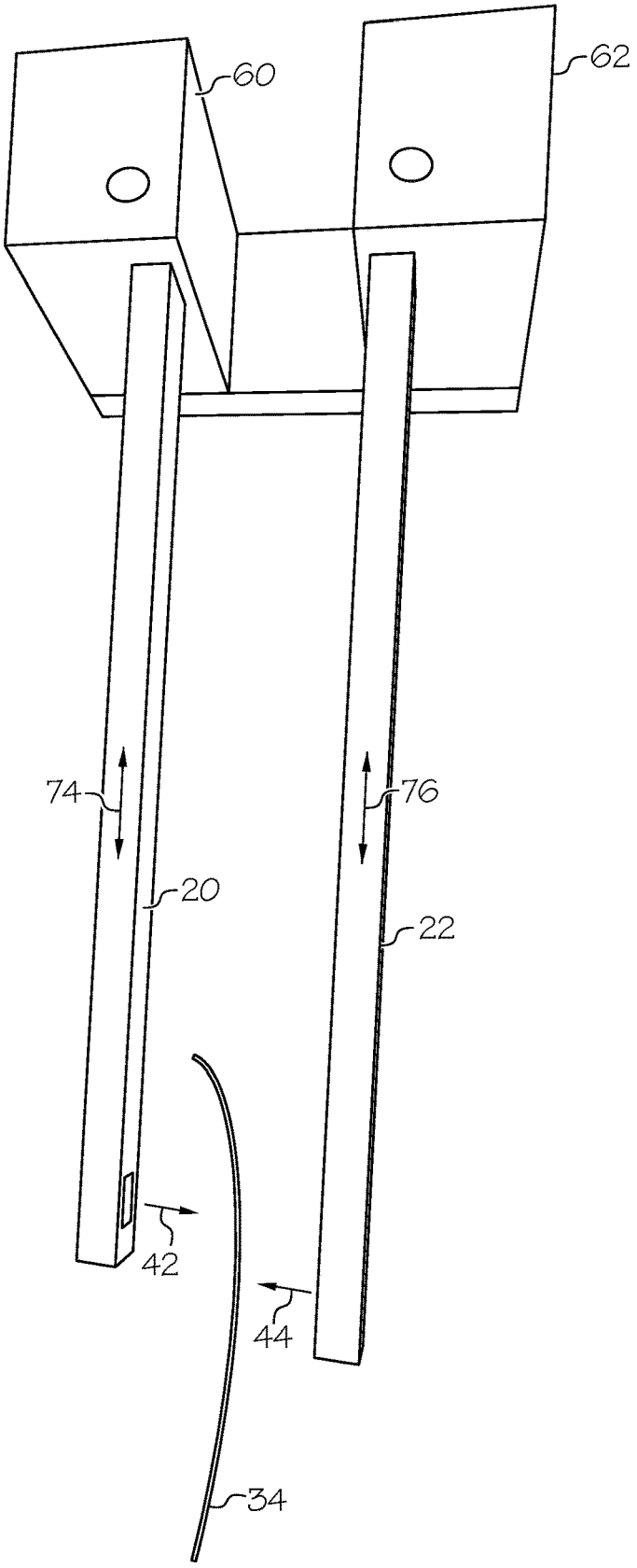
FIG. 12 is a diagrammatic perspective view illustration of an exemplary adjustable support for independently translating the dual sided shot peening nozzles of the apparatus illustrated in FIGS. 2 and 3 along longitudinal axes.

The first and second nozzles 20, 22 illustrated in FIG. 6 both translatable and/or rotatable as contrasted to the ones in FIG. 4 which are fixed. Movable or adjustable first and second nozzle supports 60, 62 in FIG. 6 may translate the first and second nozzles 20, 22 along first and second longitudinal axes 70, 72 in first and second lengthwise directions 74, 76, corresponding to first and second lengths L1, L2 respectively as illustrated in FIG. 12 during shot peening. The movable or adjustable first and second nozzle supports 60, 62 may translate the first and second nozzles 20, 22 along first and second transverse axes 80, 82 extending widthwise W between the first and second nozzles 20, 22 in first and second transverse directions 84, 86, respectively as more particularly illustrated in FIG. 8. The first and second lengths L1, L2 may be equal and the first and second streams 42, 44 of shot directly opposed and substantially co-linear. The first and second lengths L1, L2 may be unequal and the first and second streams 42, 44 of shot offset and substantially non-linear as illustrated in FIGS. 11 and 12.

Figure 9:
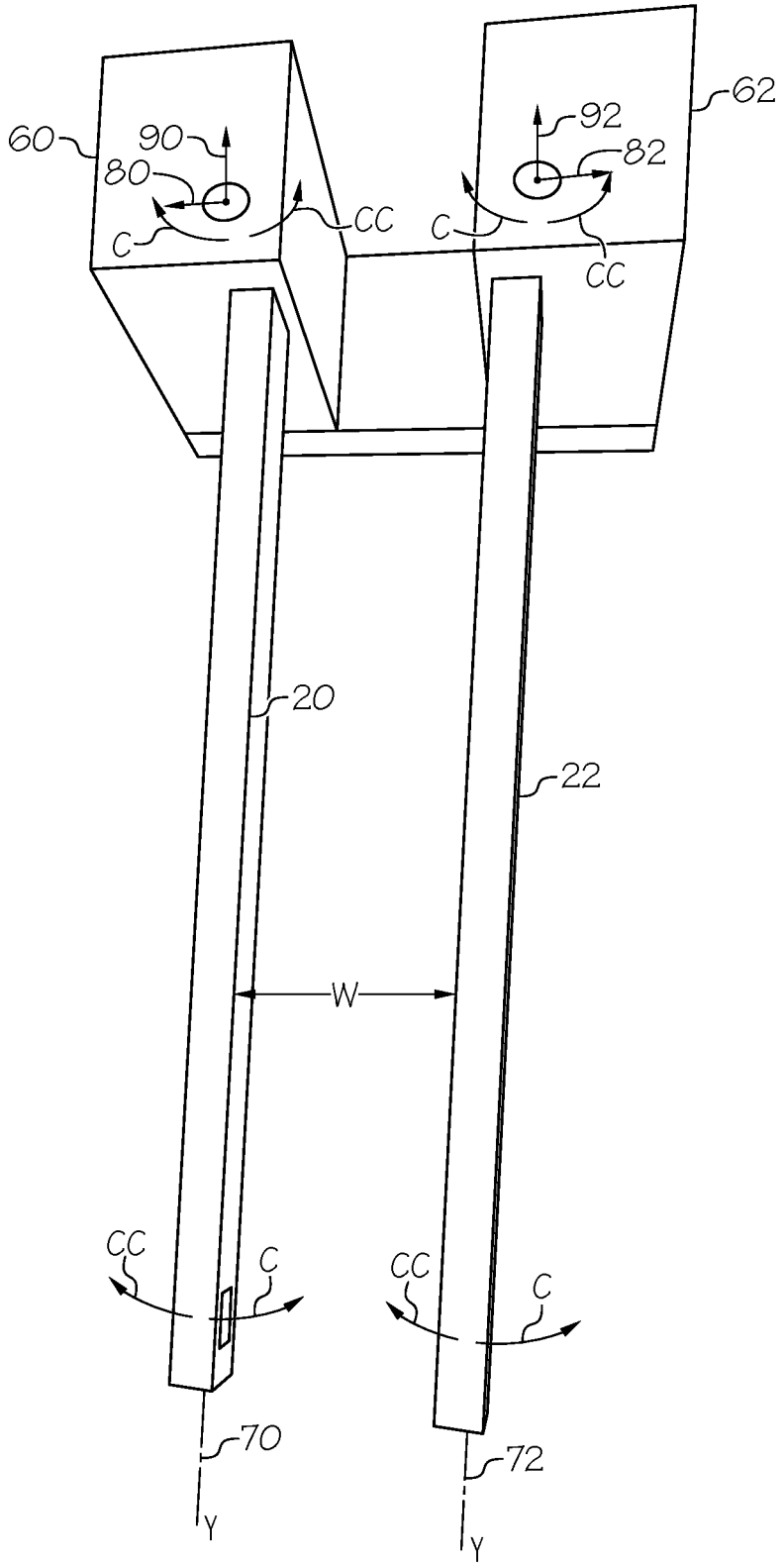
FIG. 9 is a diagrammatic perspective view illustration of an exemplary adjustable support for rotating the dual sided shot peening nozzles of the apparatus illustrated in FIGS. 2 and 3 about longitudinal and vertical axes.

The movable or adjustable first and second nozzle supports 60, 62 in FIG. 6 may also rotate the first and second nozzles 20, 22 in clockwise and counter-clockwise directions C, CC about first and second vertical axes 90, 92 that are normal to both the first and second transverse axes 80, 82 and the first and second longitudinal axes 70, 72 respectively as illustrated in FIG. 9. The movable or adjustable first and second nozzle supports 60, 62 illustrated in FIG. 9 may also rotate the first and second nozzles 20, 22 in clockwise and counter-clockwise directions C, CC about the first and second longitudinal axes 70, 72 respectively. The movable or adjustable first and second nozzle supports 60, 62 may be adjusted widthwise W.

A co-ordinate system with orthogonal X, Y, and Z axes are provided in the FIGS. The first and second longitudinal axes 70, 72, correspond to the Y axes, the first and second vertical axes 90, 92, correspond to the Z axes, and the first and second transverse axes 80, 82, correspond to the X axes. The fixed or the movable or adjustable first and second nozzle supports 60, 62 may be used to position the first and second nozzles 20, 22 during shot peening. The nozzles may be fixedly spaced apart or adjusted during the peening process. The first and second distances D1, D2 from the pressure and suction sides 46, 48 of the airfoil 34 may be set by rotating one or both of the first and second nozzles 20, 22 about the first and second vertical axes 90, 92 and/or the first and second longitudinal axes 70, 72 respectively.

First and second distances D1, D2 from the pressure and suction sides 46, 48 of the airfoil 34 to the first and second nozzles 20, 22 may be different and varied or adjusted during shot peening as illustrated in FIG. 7 and/or the first and second streams 42, 44 of shot may be tilted or rotated or canted with respect to the sides and at the same or different acute angles A and may be varied during shot peening as illustrated in FIG. 10. The first and second distances D1, D2 may also be used to illustrate first and second shot stream lengths of the first and second streams 42, 44 of shot from the first and second nozzles 20, 22 to the pressure and suction sides 46, 48 respectively of the airfoil 34 and they may be different and varied during shot peening.

The dual sided shot peening system 10 and method disclosed herein may vary and use different first and second intensities I1, I2 on the pressure and suction sides 46, 48 (concave and convex) sides respectively of the airfoils 34. The independent air pressure controls allows management of intensity decoupled from media flow rate. Various shot peening properties of the first and second streams 42, 44 can be different between the convex and concave sides of the airfoil and may be varied during the shot peening process.

These shot peening properties include, but are not limited to, shot media flow rate, intensity, impingement angle A (angle of media or shot stream exiting the nozzle with respect to the "normal" vector from the airfoil surface), distance (D1, D2) of the nozzle exit relative to the airfoil surface, and position of nozzle relative to leading and/or trailing edges LE, TE of the airfoil 34, position of nozzle relative to adjacent airfoils (which impacts ricochet peening), and peen time. A complex airfoil may have several dozen or more defined points where some or all of the "geometric and peen time" related factors or properties are changed or adjusted.

The system described above provides independently controllable air pressure and shot media flow to each peening nozzle allowing more ability to control part deflection during the dual sided shot peening process. The system and method described herein allows independent air pressure control of shot peening air pressure regulators and independent shot flow of the shot flow control valves. The system and method described herein particularly provides airfoil geometry control when shot peening a blade airfoil of a BLISK. Independent shot flow control with the shot flow control valves impacts shot peening coverage.

Independently controlling air pressure and shot media flow for the concave and convex nozzles during airfoil peening allows the operator to address airfoil motion and develop NC programs that can directly manage airfoil motion during peening. One example provides greater air pressure and shot flow on the convex or suction side of the airfoil as compared to the concave or pressure side of the airfoil to maintain the same intensity as both sides but providing full coverage incrementally faster, resulting in the airfoil maintaining geometric conformity. This also provides the ability to take pre-peening airfoil geometric information and run an adaptive program that will maintain required shot peening intensity, while selectively regulating air pressure and shot media flow during the NC-controlled nozzle movements and push the airfoil (within limits) to the desired geometric position. Airfoils that have already been peened can be annealed and re-peened to achieve the same effect.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A dual sided shot peening system, comprising:

a workpiece, the workpiece being a BLISK with airfoils;

a computer;

a first shot peening air pressure regulator and a second shot peening air pressure regulator, the first and second shot peening air pressure regulators being coupled to the computer, the first and second shot peening air pressure regulators being separate and independently controllable by the computer;

a pressurized air supply in pressurized air supply communication with the first and second shot peening air pressure regulators, a first shot supply and a second shot supply, the first and second shot peening air pressure regulators in pressurized air supply communication with the first and second shot supplies respectively, a first nozzle and a second nozzle being separate and controlled independently of each other; and a first shot flow control valve and a second shot flow control valve, the first and second shot flow control valves being coupled to the computer, the first and second shot flow control valves being separate and independently controllable by the computer, the first shot flow control valve operably disposed between the first shot supply and the first nozzle, and the second shot flow control valve operably disposed between the second shot supply and the second nozzle, a manipulator configured for supporting the BLISK, the manipulator configured for positioning opposite pressure and suction sides of the airfoil between the first and second nozzles during shot peening by the first and second nozzles, and the computer controllably connected to the manipulator;

wherein the first nozzle defines a first stream during operation and wherein the second nozzle defines a second stream during operation, and wherein the computer is configured to set different first and second intensities of first and second streams from the first and second nozzles to provide different first and second coverage rates for simultaneously shot peening the pressure and suction sides respectively of the airfoils so as to manage movement of the airfoils during the shot peening.

2. The system as claimed in claim 1, further comprising first and second nozzle supports supporting the first and second nozzles respectively and configured for fixedly or movably supporting the nozzles during shot peening.

3. The system as claimed in claim 2, further comprising first and second shot flow lines from the first and second shot flow control valves to the first and second nozzles and first and second booster lines from the first and second shot peening air pressure regulators to the first and second shot flow lines respectively.

4. The system as claimed in claim 2, wherein the first nozzle defines a first longitudinal axis and a first lengthwise direction, wherein the second nozzle defines a second longitudinal axis and a second lengthwise direction, and wherein the system further comprises the first and second nozzle supports being movable and operable to linearly move the first and second nozzles towards and away from each other and/or rotate or pivot the first and second nozzles, and/or translate the first and second nozzles along the first and second longitudinal axes in the first and second lengthwise directions, corresponding to first and second lengths of the first and second nozzles respectively.

5. The system as claimed in claim 4, further comprising first and second shot flow lines from the first and second shot flow control valves to the first and second nozzles and first and second booster lines from the first and second shot peening air pressure regulators to the first and second shot flow lines respectively.

6. The system as claimed in claim 2, wherein the computer is configured to set and vary further properties of first and second streams from the first and second nozzles for simultaneously shot peening the pressure and suction sides respectively of the airfoils.

7. The system as claimed in claim 6, further comprising the further properties selected from the group consisting of shot media flow rate, impingement angle of media or shot stream exiting the nozzle with respect to a normal vector from an airfoil surface, distance of a nozzle exit relative to the airfoil surface, and position of the nozzle relative to leading and/or trailing edges of the airfoil, position of the nozzle relative to adjacent airfoils, and peen time.

8. The system as claimed in claim 6, further comprising first and second shot flow lines from the first and second shot flow control valves to the first and second nozzles and first and second booster lines from the first and second shot peening air pressure regulators to the first and second shot flow lines respectively.

9. The system as claimed in claim 1, wherein the first nozzle defines a first longitudinal axis and a first lengthwise direction, wherein the second nozzle defines a second longitudinal axis and a second lengthwise direction, and wherein the system further comprises first and second nozzles supports that translate the first and second nozzles along the first and second longitudinal axes in the first and second lengthwise directions, corresponding to first and second lengths of the first and second nozzles respectively.

10. The system as claimed in claim 1, wherein the first nozzle defines a first longitudinal axis and a first lengthwise direction, wherein the second nozzle defines a second longitudinal axis and a second lengthwise direction, and wherein the system further comprises first and second nozzle supports being movable and operable to linearly move the first and second nozzles towards and away from each other and rotate the first and second nozzles.

11. The system as claimed in claim 1, wherein the system further comprises first and second nozzle supports being independently movable and operable to linearly move the first and second nozzles towards and away from each other.

12. The system as claimed in claim 1, further comprising first and second shot flow lines from the first and second shot flow control valves to the first and second nozzles and first and second booster lines from the first and second shot peening air pressure regulators to the first and second shot flow lines respectively.

13. A method for simultaneously shot peening pressure and suction sides of a BLISK with airfoils comprising:

supporting and moving the BLISK with a manipulator and using the manipulator to position the airfoils between a first nozzle and a second nozzle during shot peening by the first and second nozzles, shot peening with a dual sided shot peening system including a pressurized air supply in pressurized air supply communication with separate and independently controllable first and second shot peening air pressure regulators, the first and second shot peening air pressure regulators being coupled to a computer and in pressurized air supply communication with first and second shot supplies respectively, and separate and independently controlled first and second shot flow control valves being coupled to the computer and operably disposed between the first and second shot supplies and the first and second nozzles respectively, wherein shot peening comprises:

supplying pressurized air from the pressurized air supply to the first and second shot peening air pressure regulators;

metering first and second shot media in first and second shot supplies into first and second streams of the first and second shot media by flowing pressurized aft from the first and second shot peening air pressure regulators into the first and second shot supplies respectively;

flowing the first and second streams of the first and second shot media from the first and second shot supplies through individually or independently controlled first and second shot flow control valves respectively and independently regulating the first and second streams of the first and second shot media with the first and second shot flow control valves respectively;

flowing the first and second streams of the first and second shot media from the first and second shot flow control valves to the first and second nozzles respectively; and shooting the first and second streams of the first and second shot media on the pressure and suction sides respectively of the airfoils, wherein the first nozzle and second nozzle are separate and controlled independently of each other;

wherein the computer is configured to set different first and second intensities of the first and second streams from the first and second nozzles to provide different first and second coverage rates for simultaneously shot peening the pressure and suction sides respectively of the airfoils so as to manage movement of the airfoils during the shot peening.

14. The method as claimed in claim 13, further comprising controlling the first and second shot flow control valves to flow different amounts of the first and second streams of the first and second shot media and/or controlling the first and second shot peening air pressure regulators for flowing pressurized air to the first and second shot supplies at different pressures respectively.

15. The method as claimed in claim 14, further comprising flowing the first and second streams of the first and second shot media from the first and second shot flow control valves through first and second shot flow lines to the first and second nozzles respectively and flowing pressurized air from the first and second shot peening air pressure regulators through first and second booster lines to the first and second shot flow lines respectively.

16. The method as claimed in claim 13, further comprising using the computer to set and vary further properties of first and second streams from the first and second nozzles for simultaneously shot peening the pressure and suction sides respectively.

17. The method as claimed in claim 16, further comprising the further properties selected from the group consisting of shot media flow rate, impingement angle of media or shot stream exiting the nozzle with respect to a normal vector from an airfoil surface, distance of a nozzle exit relative to the pressure and suction sides, position of the nozzle relative to leading and/or trailing edges of a portion, position of the nozzle relative to adjacent portions, and peen time.

18. The method as claimed in claim 16, further comprising flowing pressurized air through first and second shot flow lines from the first and second shot flow control valves to the first and second nozzles and first and second booster lines from the first and second shot peening air pressure regulators to the first and second shot flow lines respectively.

19. The method as claimed in claim 13, further comprising supporting and independently moving the first and second nozzles during the peening with first and second nozzle supports respectively of the system, moving the first and second nozzles linearly towards and away from each other and/or rotating or pivoting the first and second nozzles, and/or translating the first and second nozzles along first and second longitudinal axes in first and second lengthwise directions, corresponding to first and second lengths of the first and second nozzles respectively.

20. The method as claimed in claim 13, further comprising moving the manipulator to move first and second streams from the first and second nozzles in a serpentine pattern including one or more U-shaped first portions.

* * * * *